US011161659B2

(12) United States Patent
Thomsen

(10) Patent No.: US 11,161,659 B2
(45) Date of Patent: Nov. 2, 2021

(54) CLOSURE FOR A FLUID-FILLED CONTAINER

(71) Applicant: REMY & GEISER GMBH, Hinternah (DE)

(72) Inventor: Nils Thomsen, Hamburg (DE)

(73) Assignee: REMY & GEISER GMBH

( * ) Notice: Subject to any disclaimer, the term of this patent is extended or adjusted under 35 U.S.C. 154(b) by 586 days.

(21) Appl. No.: 16/065,070

(22) PCT Filed: Dec. 22, 2016

(86) PCT No.: PCT/EP2016/002160
§ 371 (c)(1),
(2) Date: Jun. 21, 2018

(87) PCT Pub. No.: WO2017/108186
PCT Pub. Date: Jun. 29, 2017

(65) Prior Publication Data

US 2018/0370698 A1 Dec. 27, 2018

(30) Foreign Application Priority Data

Dec. 23, 2015 (DE) ..... 10 2015 016 817.7

(51) Int. Cl.
*B65D 51/22* (2006.01)
*B65D 1/02* (2006.01)
*B65D 47/36* (2006.01)

(52) U.S. Cl.
CPC ..... *B65D 51/225* (2013.01); *B65D 1/0246* (2013.01); *B65D 47/36* (2013.01); *B65D 2251/0025* (2013.01); *B65D 2251/0062* (2013.01); *B65D 2251/0087* (2013.01); *B65D 2401/20* (2020.05); *B65D 2401/25* (2020.05)

(58) Field of Classification Search
CPC ... B65D 51/225; B65D 47/36; B65D 2401/12
USPC ..... 206/222; 215/208
See application file for complete search history.

(56) References Cited

U.S. PATENT DOCUMENTS

| | | | | |
|---|---|---|---|---|
| 3,881,625 A * | 5/1975 | Landen | B65D 50/046 215/221 |
| 4,487,324 A | 12/1984 | Ostrowsky | 215/253 |
| 4,747,498 A | 5/1988 | Gach | 215/232 |
| 4,895,282 A | 1/1990 | Robinson | 222/482 |

(Continued)

FOREIGN PATENT DOCUMENTS

| | | | |
|---|---|---|---|
| AT | 387946 | 4/1989 | B65D 47/08 |
| DE | 4323666 | 1/1994 | B65D 17/42 |

(Continued)

OTHER PUBLICATIONS

International Preliminary Report on Patentability (w/translation) issued in application No. PCT/EP2016/002160, dated Jun. 26, 2018 (12 pgs).

(Continued)

*Primary Examiner* — Anthony D Stashick
*Assistant Examiner* — Raven Collins
(74) *Attorney, Agent, or Firm* — Hayes Soloway P.C.

(57) ABSTRACT

The disclosure relates to a closure having a sealing element for a fluid-filled container. The closure has at least one securing mechanism which is designed to be irreversibly changed in a visible manner during the first opening of the closure.

26 Claims, 9 Drawing Sheets

(56) References Cited

U.S. PATENT DOCUMENTS

| | | | | | |
|---|---|---|---|---|---|
| 5,145,080 | A | 9/1992 | Imbery, Jr. | | 215/331 |
| 5,992,659 | A | 11/1999 | Nofer et al. | | 215/235 |
| 5,992,692 | A | 11/1999 | Boissay | | 222/83 |
| 6,116,445 | A * | 9/2000 | Ikemori | B65D | 47/0804 215/254 |
| 2013/0292275 | A1* | 11/2013 | Smart | B65D | 51/2835 206/222 |

FOREIGN PATENT DOCUMENTS

| | | | | |
|---|---|---|---|---|
| DE | 102010029259 | 12/2011 | ..... | B65D 41/20 |
| DE | 102011055700 | 5/2013 | ..... | B65D 47/08 |
| FR | 2533890 | 4/1984 | ..... | B65D 47/10 |
| FR | 2673608 | 9/1992 | ..... | B65D 55/02 |
| GB | 2 101 981 | 6/1982 | ..... | B65D 55/02 |
| WO | WO9623707 | 8/1996 | ..... | B65D 47/18 |
| WO | WO 2008044442 | 4/2008 | ..... | B65D 51/22 |

OTHER PUBLICATIONS

International Search Report and Written Opinion (w/translation) issued in application No. PCT/EP2016/002160, dated Mar. 15, 2017 (17 pgs).

European Official Action issued in related European Patent Application Serial No. 16 834 235.0, dated Jul. 8, 2020 with translation (11 pgs).

* cited by examiner

CLOSURE FOR A FLUID-FILLED CONTAINER

BACKGROUND OF THE INVENTION

From the prior art, closure systems are known which are used by means of a sealing film or a tamper-evident strip for tamper-proofing for example medicaments or beverages, in order to indicate the tamper-free condition after the filling process at the manufacturer's site. Moreover, foils/films may be used as protective barriers for extending the shelf life of sensitive contents by ensuring a level of tightness that goes beyond the tightness that is achieved using simple closure caps or caps with metering inserts according to the present prior art.

Moreover, closure systems are known from the prior art which contain metering elements applied to the container opening. It has so far not been possible to protect such closure systems using barrier films at the same time, especially where the container openings are relatively small.

In known closure systems from the prior art, sealing films are opened in the course of the initial screw opening process and have to be subsequently removed. Tamper-evident strips tear off in a visible manner during initial unscrewing. Sealing films provided below screw caps do not constitute reliable tamper-proofing because they are not visible but the closure itself has to be secured against opening.

Document DE 43 23 666 A1 describes a self-piercing closure device for small bottles. On the outside of the closure device, a warranty seal is provided which has to be torn off in order to gain access to the content of the small bottle. This means that the warranty seal may also fulfil the function of tamper-proofing. However, due to the external attachment of the warranty seal, there is a risk that the latter could become damaged or manipulated during production or transport.

SUMMARY OF THE INVENTION

It is the object of the present invention to provide a particularly tamper-proof closure which is also simple in design, can be produced as cost-efficiently as possible and is easy to handle.

According to the invention, a closure having a sealing element for a container filled with a fluid is provided with at least one securing mechanism arranged to be irreversibly changed in a visible manner upon initial opening of the closure. The irreversible change may manifest itself for example by the fact that an element of the closure is torn off, broken off, permanently deformed and/or discoloured as a result of the opening process. As a result of such a securing mechanism, it can be detected by the user beyond doubt whether the closure is still as originally sealed. As a result, the consumer can ascertain whether the content of the container is still in its original condition or whether its shelf life has been adversely affected by a prior opening of the closure or whether it may have been manipulated and/or contaminated.

The securing mechanism may comprise at least one visible securing element that is irreversibly changed in a visible manner due the application of a force on the closure relative to the container, which force has at least one force component along an axis perpendicular to an opening level of an opening of the container that was closed by the closure. The force mentioned above is greater than the force a user would normally apply in order to open the closure, and in particular significantly greater than any forces that would normally occur during transport of the closure and the container. As a result of its direction, the force effects a movement of the closure onto the opening of the container towards it and away from it. This means that a visible irreversible change occurs particularly if an attempt is made to remove the closure from the container or to push it against the container, for example in order to gain access to the opening and thus to the content of the container. As a result of the solution according to the invention, also an inadvertent intervention, for example as a result of improper handling or improper transport, in the closure is indicated.

The securing element may be provided on the side of the closure that faces the container, and/or may be arranged to space the closure apart from the container. As a result, it may be designed in a structurally simple manner in such a way that it will be irreversibly changed during said application of force, and/or it will reliably prevent the container from being opened.

The securing element may be connected to the closure via at least one, for example tensionally unstable, in particular radially unstable, predetermined breaking point. As a result of the predetermined breaking point, the securing element may get detached from the closure as a result of an, in particularly specifically radial, application of force in a predictable and well visible manner. Alternatively, the securing element may comprise a predetermined kinking point. The kinking of the securing element, predefined by the predetermined kinking point, is preferably visible and irreversible. According to a particular embodiment of a securing element having a predetermined kinking point, the securing element may be pushed either completely or only partially under the closure or in particular the first and/or second elements by sliding the first and second elements into the second position. Apart from the indication effect, this pushing under may also have a clamping effect in order to additionally secure the closure in the second (usage) position.

The securing element may surround the opening closed by the closure, preferably essentially in an annular manner. As a result, the opening and thus the content of the container is additionally protected against manipulation.

The securing element may be designed so that it can be torn off from the closure, and the securing element may comprise for example a handle element, in particular a tab. Due to the fact that the securing element is designed so that it can be torn off, for example by means of predetermined breaking points between the securing element and the closure and/or within the securing element, it can be removed by the user in order to open the closure in an unhindered manner. Due to the use of a handling element, in particular a tab, the tearing off can be accomplished in a particularly simple manner. Due to the fact that the tab is circumferentially connected to the securing element by a tear-off element, inadvertent or premature tearing off for example during the handling or closing process will also be prevented, especially since the circumferentially attached tear-off element is advantageously designed in such a way that it offers only few attacking points for mechanical interference.

The securing element and/or the first and/or the second element may have latching means such as at least one latching nose, wherein the container may have for example at least one latching pin that is complementary to the latching nose. Alternatively, also the at least one latching pin may be provided for example on the securing element and/or at least one latching nose on the container that is complementary thereto. The latching nose and the latching pin may cooperate in a form-locking manner during a movement of the securing element along the axis away from the container and in a force-locking manner during a movement thereof towards the container. The terms "latching nose" and "latching pin" are not to be understood to have a limiting effect on the form of the latching element but are merely intended to illustrate their functional interplay. According to the invention, latching means between the first and second elements secure two positions preferably into latching stages against tampering, namely in particular the first position of the first and second elements which is adjusted during production (e.g. "delivery position"), and a second position (e.g. "usage position") generated by the user of the container. The securing element, however, may according to the invention be designed with just one latching stage in a user-induced position, with the first element, the second element and/or the container as the latching partner. Advantageously, the securing element cooperates with the first element if at all only slightly in a force-locking manner, so that the first element may be decoupled, at least to a large degree, from force effects of the securing element.

By means of latching noses and/or latching pins, the securing element may be reliably held in its position on the container. As a result of a force-locking connection of the latching noses and the latching pins during a movement of the securing element towards the container, the closure together with a security element may be attached to the container whilst overcoming the resistance during the filling process, which is caused by the form lock. The form-locking connection in the opposite direction prevents a pulling off of the securing element and in particular the closure with the security element from the container. Advantageously, the resistance caused by the form lock, for example as a result of a suitable choice of material and/or shape, may be selected to be greater than the force necessary for an irreversible change to the security element. As a result it is assured that the closure cannot be pulled off from the container without irreversibly and visibly changing the securing element.

The securing element may consist of at least one elastically deformable material, preferably made from a plastic. The use of an elastic material ensures that the securing element will not already be irreversibly changed for example during filling or during transport, but only in the case of an attempt to open the container.

The closure may comprise a second element and a first element for receiving the second element. Here, the first element and the second element may be displaced relative to each other from a first position into a second position, and in the first position the sealing element is intact and in the second position the sealing element has been penetrated by the second element. The first element and the second element are preferably connected to each other in all positions. For example, the second element may be an insert for the first element. The sealing element may here be attached in the first element by means of a sealing ring and may in particular be tensioned by the sealing ring. Moreover, a sealing ring is advantageous in order to maintain a reliable seal and in order to facilitate a simpler attachment of the sealing element in the first element. The sealing ring is here adapted in its size to the circumference of the first element, so that a reliable seal is ensured. The fluid may for example be a drinking fluid, such as for example water, or a drinkable or inhalable, in particular gaseous medicament or one that evaporates or sublimes under ambient conditions.

For example, at least one control element is attached to the second element as part of the securing mechanism, through which control element it can be seen whether the second element is still in its initial position. As a result, it is meant to be more evident and simpler to detect whether an opening action has already been carried out, in order to indicate the tamper-free condition to consumers.

Further, the at least one control element is irreversibly changed by displacing the second element relative to the first element. As a result of the irreversible change to the at least one control element it is ensured that, if the second element is brought back into the initial position after the initial opening, it can be detected that an opening process of the container has already occurred. In this case, suitable control elements are in particular for example so-called flaps which, when the second element is pushed in, kink in a visible and irreversible manner. In particular, a prior opening of the container may be detected by deformations or material discolorations for example as a result of material fatigue on the control elements. It is also conceivable to connect the first element and the second element to each other in an unopened initial condition of the container, and the connection can be separated by means of a displacement from the first position into the second position using an amount of force that is low for a user of the container. Such a connection may for example be an at least partial welding of the first element to the second element. However, also other embodiments such as for example a seal strip attached between the first and second elements are conceivable, which seal strip tears off when pushed in, thus indicating an initial opening.

The second element can essentially completely envelope the first element at least on the side facing away from the container. As a result, the first element may be concealed and thus additionally be protected against manipulation. This is prudent in particular if the first element is used to fix a sealing element on the container. By concealing the first element, thus also manipulations on the sealing element that is essential for the protection of the container content are prevented.

In an advantageous embodiment, at least one cutting surface for severing the sealing element at least partially or in sections is provided on the second element. Such a cutting surface is advantageous in order to ensure a reliable severing and in order to provide a sufficient opening, through which the fluid can exit. It is conceivable to remove a section from the sealing element or to generate, by means of a preferably nonlinear cut, an opening in the still connected sealing element. Moreover it is advantageous that the cutting surface is a part of the second element and is located on the part of the second element that is located closest to the sealing element in the displacement direction. However, it would also be possible to attach the cutting surface via an attachment or the like to the second element. Further it is also possible to provide a plurality of cutting surfaces on the second element in order to sever the sealing element in several places at the same time. The cutting surfaces are designed such that the opening generated thereby can carry a fluid flow and ensures the latter, which at least corresponds to that of a spout of the closure.

In a particular embodiment, the closure comprises a holding element for holding a movable section generated by severing the sealing element. By holding such a movable section, the movable section is secured in a defined holding position, so that a constant flow of fluid through the penetrated sealing element is ensured. This prevents for example that a lobe-shaped movable section of the sealing element is movable in the fluid flow or flaps. The holding element may be designed for example in a spit-shaped manner for skewering a section of the sealing element, and is preferably movable in the piercing direction against the sealing element and is even more preferably provided with barbs for holding the section of the sealing element in the piercing direction.

The closure may have an internal thread that is complementary to an external thread of the container. Alternatively, the closure may also have an external thread that is complementary to an internal thread of the container. As a result, the closure may be securely fastened to the container by screwing it on. The closure may here have for example be a ratchet that is designed to allow the closure to be screwed onto the container and to prevent the closure from being screwed off from the container. As a result of the ratchet, the closure may be readily screwed on during the filling process, however it can no longer be removed thereafter, so that an unnoticed access to the container content is not possible. In particular, also any possible fixing of the sealing element on the container by the closure cannot be compromised.

The ratchet may have a number of for example three follower ribs and/or an in particular a same number or a number that is divisible by an integer or a multiple of for example three snap-on ribs. Here, in particular the follower ribs may be provided on a first part of the closure that is accessible from the outside of the closure, and/or the snap-on ribs may be provided on a second part of the closure that is connected to the internal thread. The first and second parts of the closure may in particular be the first and second elements of the closure. Alternatively, the arrangement of the follower ribs and the snap-on ribs may also be interchanged. During the screwing on of the closure, the follower ribs and the snap-on ribs cooperate in a form-locking manner, so that a rotary movement of the first part of the closure is transmitted onto the internal thread, so that the closure may be screwed on tightly. In the case of a screwing-off attempt, the follower ribs and the snap-on ribs cooperate only in a force-locking manner, and the ratchet is preferably designed in such a way that the maximum torque that can be transmitted by the form lock is lower than the minimum torque that is required for screwing the closure off from the container. As a result, in the case of an attempt of screwing the closure off, only the first part of the closure rotates, whereas the second part of the closure, which carries the thread, remains firmly on the container and in particular maintains the sealing effect of the sealing element.

The sealing element may be formed as a film type, preferably as a multi-layer sealing film, in order to ensure a good seal of the internal cavity of the container against the environment of the container.

It is possible for the sealing element to be connected in a firmly bonded manner neither with the closure nor with the container. The sealing element may in particular simply be placed within the closure and/or may be placed on the container and may be clamped between the closure and the container by attaching the closure to the container. As a result, the need for an additional fastening step for the sealing element for example by welding during production and/or during filling is eliminated. Advantageously, the sealing element may be clamped in the closure in a movable, but captive manner.

It is further advantageous if the sealing element is designed as a circumferential sealing element made from an elastic material. It is particularly preferred here that the sealing element is made from an extensive closed pore foam. To this end, above all PE foam is suitable, in particular due to its elasticity and its low production costs. The use of a foam has the advantage, with regard to sealing the various elements, that the latter is uniformly pressed against the various elements. This also allows a reliable sealing effect to be ensured even in the case of greater manufacturing tolerances in the first and second elements. In particular, the extensively designed closed pore foam is covered with a film element at least on one side. An additional attachment of a foil offers the advantage that the foam, in particular for example also for alcoholic solutions, becomes impermeable so as to ensure a reliable seal. Aluminium is preferably used as the material for the foil.

In particular, the sealing element may be provided with weak points that are impermeable to the fluid, which act as predetermined breaking points for a predefined opening of the sealing element. The predefined opening occurs for example when the sealing element breaks only on one side when displacing the second element into the second position, and/or is pushed towards one side in such a way that the sealing element does not substantially reduce the cross-sectional area of the opening of the container that is closed by the closure. As a result, in particular a combination with a metering element is facilitated, which relies on a fluid flow from the container that is as unhindered as possible.

Further, at least one, preferably exactly one, return channel is provided in the closure, in particular in the second element, via which air can get into the container. To this end, the closure, in particular the second element, may be provided with at least one vent.

In a further advantageous embodiment, a channel for fluid is provided in the closure, in particular in the second element, particularly eccentrically. An eccentric arrangement, and also a cross section of the fluid channel that is as large as possible, are in each case particularly advantageous in order to optimise a maximum through-flow through the return channel in any given design of the closure. Thus, a possible capillary effect may be substantially reduced or completely prevented. However, it would also be conceivable to have a central arrangement of the fluid channel, as a result of which an annular return channel would be obtained. However, this is not advantageous because in the case of small spaces, a stronger capillary effect occurs in an annular return channel. Further, as a result of a central arrangement of the fluid channel, a plurality of return channels is possible. A plurality of return channels offers the possibility of ensuring a higher structural stability as a result of a larger number of walls between the return channels. A circumferential return channel is advantageous because it allows any residual medium in the closure element to be recycled back into the bottle.

It is further possible for the first and second elements to be sealed against each other via sealing surfaces at least in the second position. Particularly advantageous is such a sealing in the second position because the sealing element is severed in this position and the sealing that exists as a result of the sealing element thus no longer completely exists. To this end, the sizes of two elements are matched to each other in such a manner that external surfaces of the second element in a certain area cooperate in a sealing manner at least partially with complementary internal surfaces of the first element, whilst at the same time displacement of both elements relative to each other is still possible. In this connection, at least the first element is made from an at least partially elastic material, for example from polyethylene (PE), in order to facilitate displacement. If polyethylene is used, this may be of the HD (high density; PE-HD) or the LD (low density; PE-LD) type. PP and PE are preferred because types are available for these materials that are certified and admissible for foodstuffs or medicaments. Alternatively, it is possible for the second element to cooperate in a sealing manner with a sealing element and/or the sealing ring in the second position. Such cooperation of these elements is advantageous because in this way, a reliable sealing after the initial opening can be ensured.

Particularly preferably, the first element and/or the second element are provided with at least one latching nose and/or with at least one latching pin that is complementary to the latching nose. The purpose of providing latching noses and complementary latching pins is that the second element is reliably held both in the first and in the second positions.

In a further preferred embodiment, the at least one latching nose acts only in a form-locking manner against a displacement direction and/or in a force-locking manner along the displacement direction. A form-locking connection against the displacement direction is advantageous because in this way, an undesired pulling out of the second element from the first element is reliably prevented. Further it is also prevented that the second element slides out of the first element by itself during transport. A force-locking connection along the displacement direction is advantageous because in this way a certain force has to be applied in order to carry out the initial opening process, which prevents an accidental and self-induced pushing in or sliding of the second element for example during transport. Further advantageously, the second element is still secured against pushing back after displacement on the first element by a number of latching noses and complementary latching pins in the second position, e.g. the use position, in order to reliably maintain the tightness between the first and second elements. The sealing effect may be generated either between the first and the second element, the first element and the container and/or the second element and the container, preferably by pressing the sealing element between the respective sealing partners.

Advantageously, a cap is provided for sealing, which preferably seals both the liquid channel and the return channel. This cap may in particular be suitable for reversibly closing the container after initial opening. The cap is here advantageously designed in such a way that it is fastened, via a flexible element, for example a film hinge, to the closure, in particular on the first or the second element, and can thus simply be folded over the two channels. Closing of the two channels is necessary in order to ensure that no fluid can exit from the container even if the container is not stored in an upright position. The cap, or at least a coating of the cap, and the flexible element, at least however the flexible element, may be made from an elastic material such as for example polyethylene (PE) or the like. Further, a variety of other types of rubber such as for example styrene-butadiene rubber (SBR) or the like are conceivable, which have a sufficient flexibility in order to allow pivoting of the cap.

The cap may advantageously be formed without its own securing mechanism. As a result of a securing mechanism according to the invention, the necessity of securing the cap against improper opening is eliminated. As a result, the cap can be produced in a simpler and more cost-effective manner and can be opened more simply by a consumer.

Further, particularly preferable, a facility for securing against manipulation is provided in the fluid channel and/or in the at least one return channel, in such a way that there is no free, substantially linear path from a pour opening or a return opening to the sealing element. Particularly advantageously, the facility for securing against manipulation has lateral openings and a closed underside and/or vaulting provided on the sealing element. The underside and/or vaulting is for example a continuous surface or a surface that is interrupted in sections, which is for example secured against penetration by a syringe. By means of a manipulation security designed in such a way it is intended to be reliably prevented that the content of the bottle is manipulated from the outside, for example by means of a syringe, for which the sealing element is accessible through an opening of the closure. The lateral openings ensure that after opening, the fluid reaches the pour opening through the fluid channel.

BRIEF DESCRIPTION OF THE DRAWINGS

Further advantages and embodiments will become evident from the attached drawings.

Any technical features listed therein are also claimed in isolation from their combination of features which is listed only by way of example. Any technical features having the same or a similar effect are identified with the same reference numerals. For the sake of clarity, the identification with reference numerals of technical features shown several times has partially been omitted. In the figures:

DETAILED DESCRIPTION OF THE DRAWINGS

Figure 1:
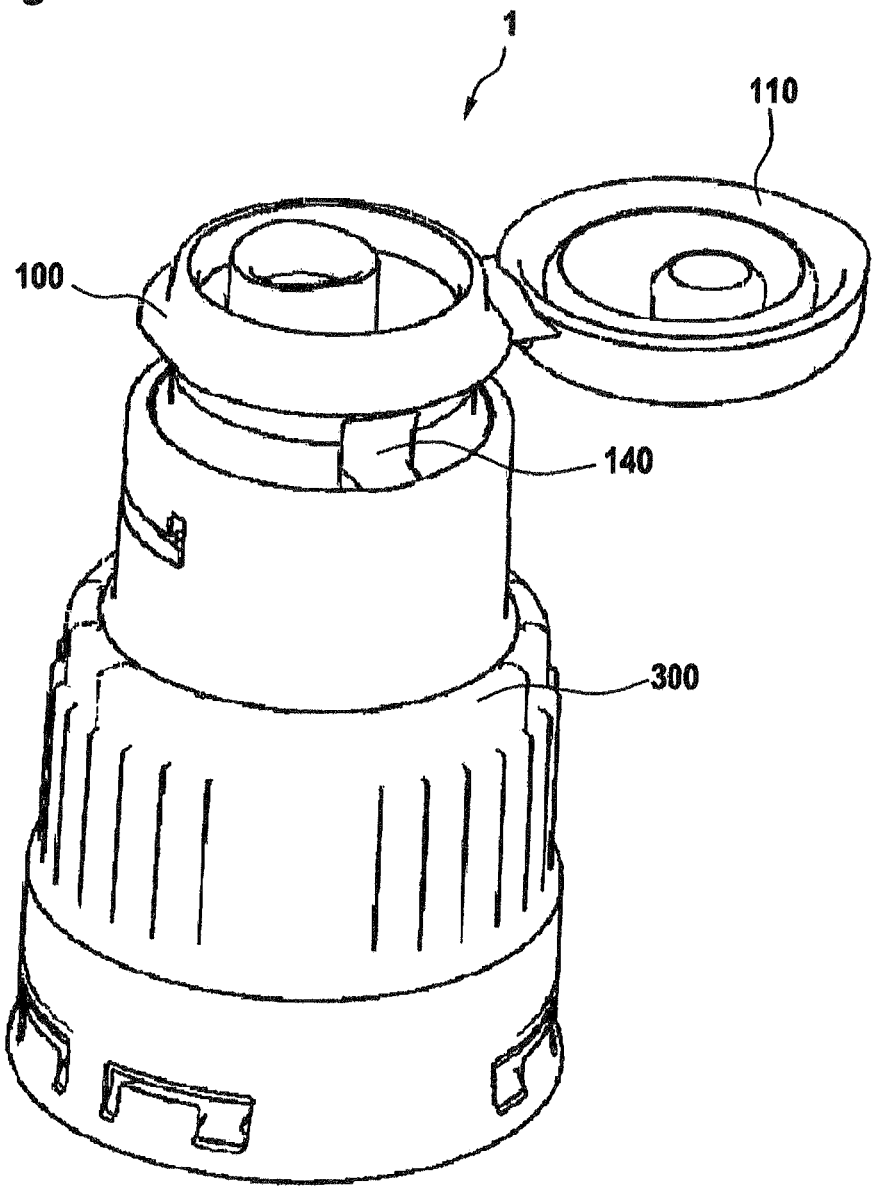
FIG. 1 shows a three-dimensional view of a first embodiment of the closure in the first position.

FIG. 1 shows a three-dimensional view of the closure 1 according to the invention. This shows the first element 300 as well as the second element 100. Further, the cap 110 is shown which seals the second element 100 after the initial opening. Moreover, an example of a form of the control elements 140 is illustrated, which irreversibly snap off upon initial opening.

Figure 2:
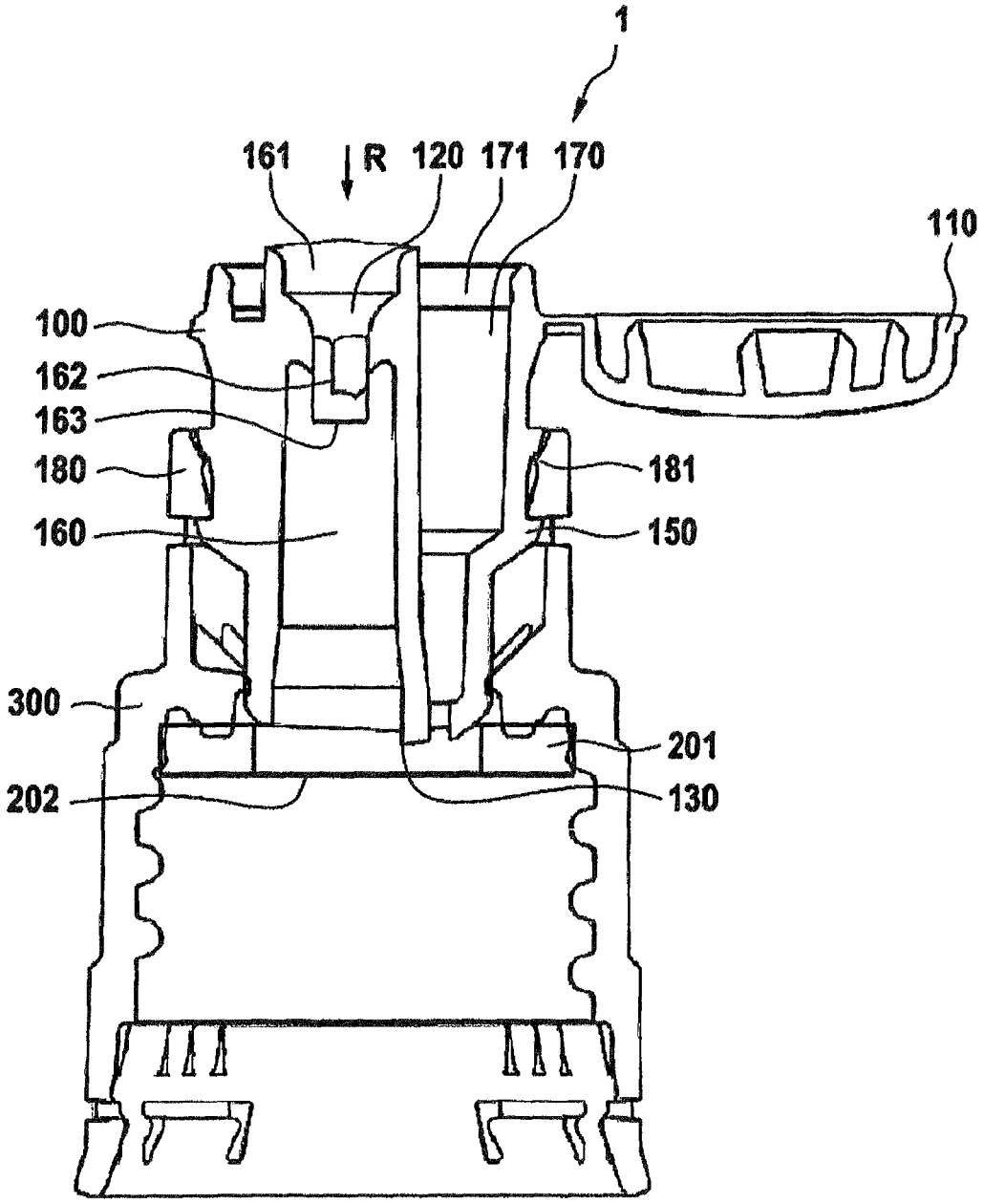
FIG. 2 shows a further cross-sectional view of the closure according to a first embodiment in the first position.

FIG. 2 shows a cross-sectional view of the closure according to a first embodiment. Here, the second element 100 is in the first position and the sealing element 202 is intact. In this figure, two latching pins 150 are provided which hold the second element 100 in the first position relative to the first element 300. Further, a metering element 120 is provided above the fluid channel 160. As a result of the fact that a closure according to the invention may have both a sealing element 202 and a metering element 120, a particularly high level of security is ensured by the sealing element 202, whilst at the same time easy handlability is achieved by the metering element 120. In this embodiment, a return channel 170 is provided adjacent to the fluid channel 160. The sealing element 202 may here be held and clamped onto a sealing ring 201. On the underside 163 and/or a vaulting 164 (see FIG. 6 or 9) of the second element 100, a cutting element 130 in the form of a cutting edge may be provided. Moreover, latching noses 180 are provided on the first element 300, into which, depending on their position, at least one of the latching pins 150 latches. In a preferred embodiment, the latching noses 180 carry at least one latching cusp 181. A latching cusp 181 according to the invention generates a predefined resistance in the displacement direction R. Thus, a user of the container moreover receives a tactile and/or acoustic feedback regarding the initial opening of the container.

Figure 3:
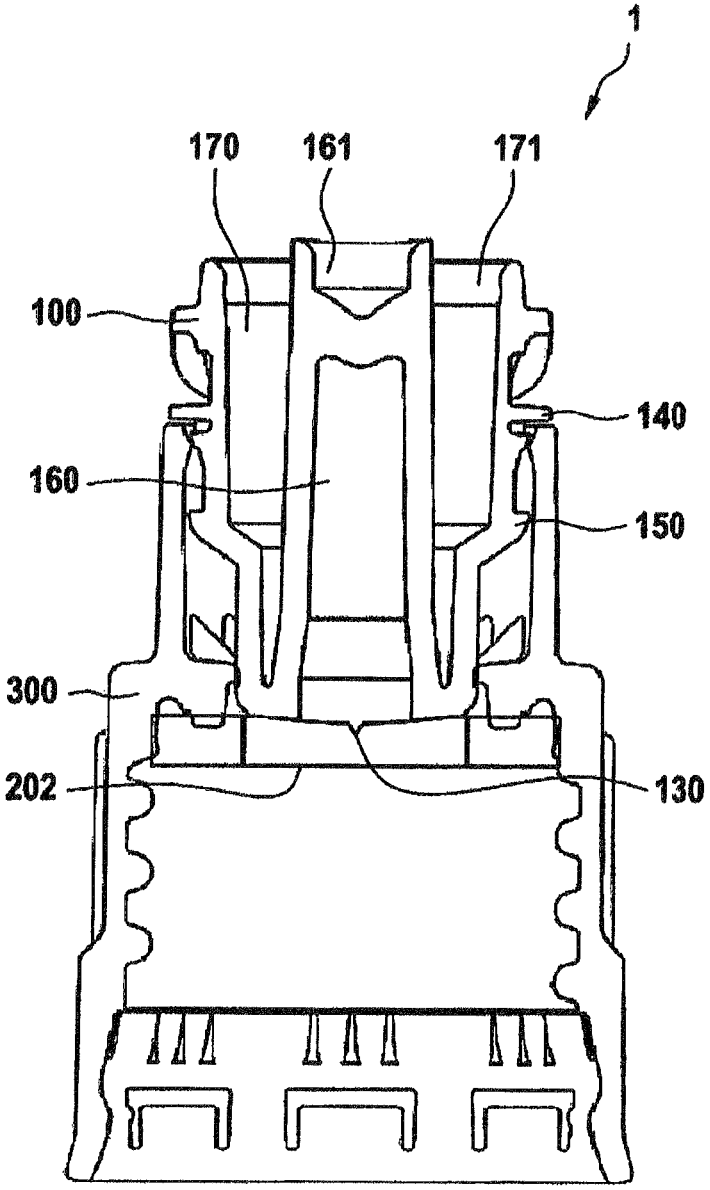
FIG. 3 shows a cross-sectional view of the closure according to an alternative embodiment in the first position.

FIG. 3 also shows a cross-sectional view of the closure. However, FIG. 3 shows an alternative embodiment of the closure and is rotated by 90°. Here, the cutting element 130 may be formed as a mandrel and/or cutting edge, by means of which the sealing element 202 may be penetrated. Further, this illustration shows the control elements 140 that snap off during the initial pushing-in process. Moreover, no latching noses 180 for the latching pins 150 can be seen. Also, the cap 110 cannot be seen in this illustration.

Figure 4:
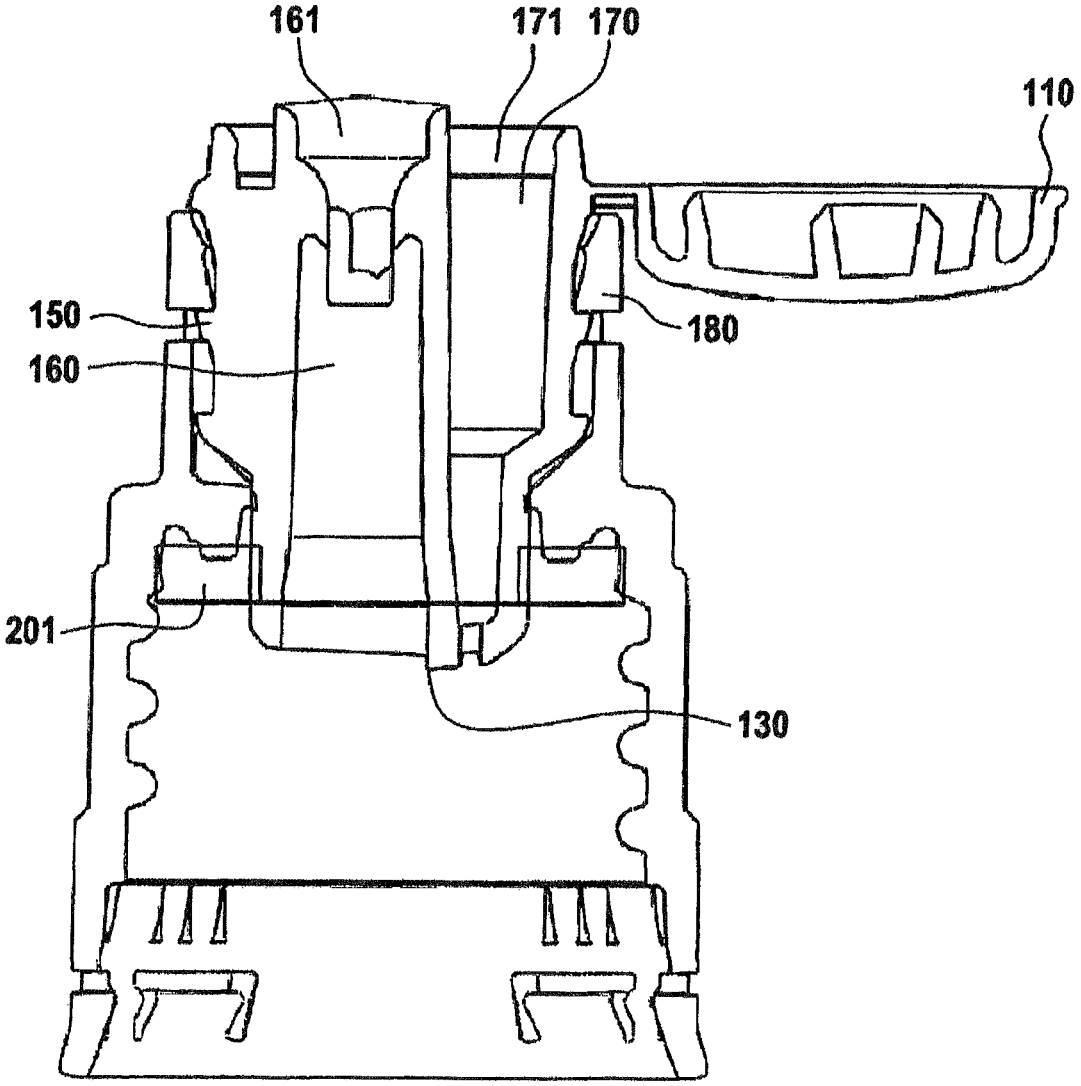
FIG. 4 shows a cross-sectional view of the closure according to a first embodiment in the second position.

FIG. 4 corresponds to the cross-sectional view of FIG. 2. However, in this figure the second element 100 is in the second position and the sealing element 202 is severed by the cutting element 130.

Figure 5:
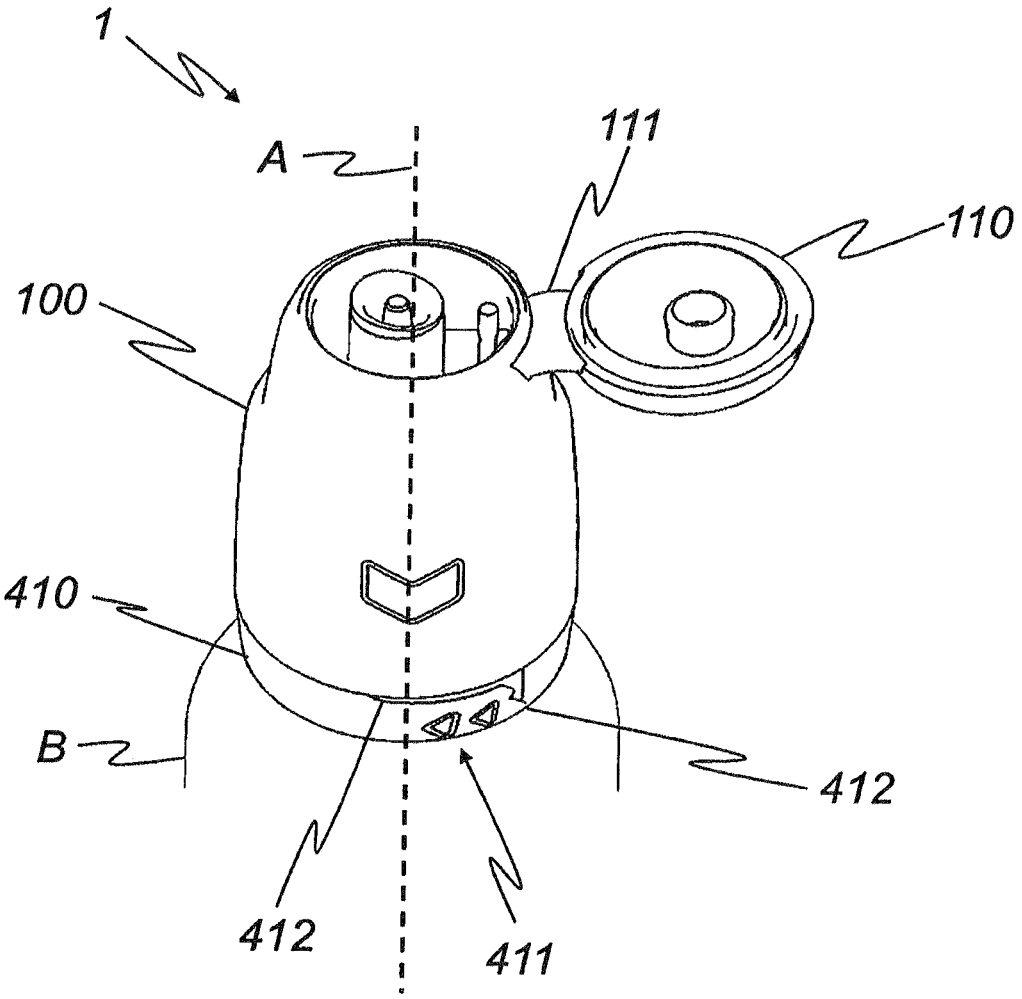
FIG. 5 shows a three-dimensional view of an embodiment of the closure.

FIG. 5 shows a three-dimensional view of an embodiment of the closure 1. The closure 1 has a cap 110 that is shown in the open condition, which is connected to the closure 1 via a flexible element 111, for example in the form of a film hinge. The closure 1 shown comprises a second element 100 which completely envelopes a first element 300 of the closure 1 up to the side facing the container B (not visible). On the second element 100, a securing element 410 is attached via a predetermined breaking point 412. The securing element 410 shown surrounds an opening (not visible) of the container B, which is closed by the closure 1, in an annular manner and has a handle element 411 in the form of a tab and a further predetermined breaking point 412, so that the securing element 410 can be torn off from the closure 1 by a consumer. The further predetermined breaking point 412 prevents the securing element 410 from being prematurely or inadvertently torn off unnoticed by handling or by the closing process during production. According to the invention, the predetermined breaking points 412 may be designed so as to be radially unstable to tension with regard to the axis A.

Figure 6:
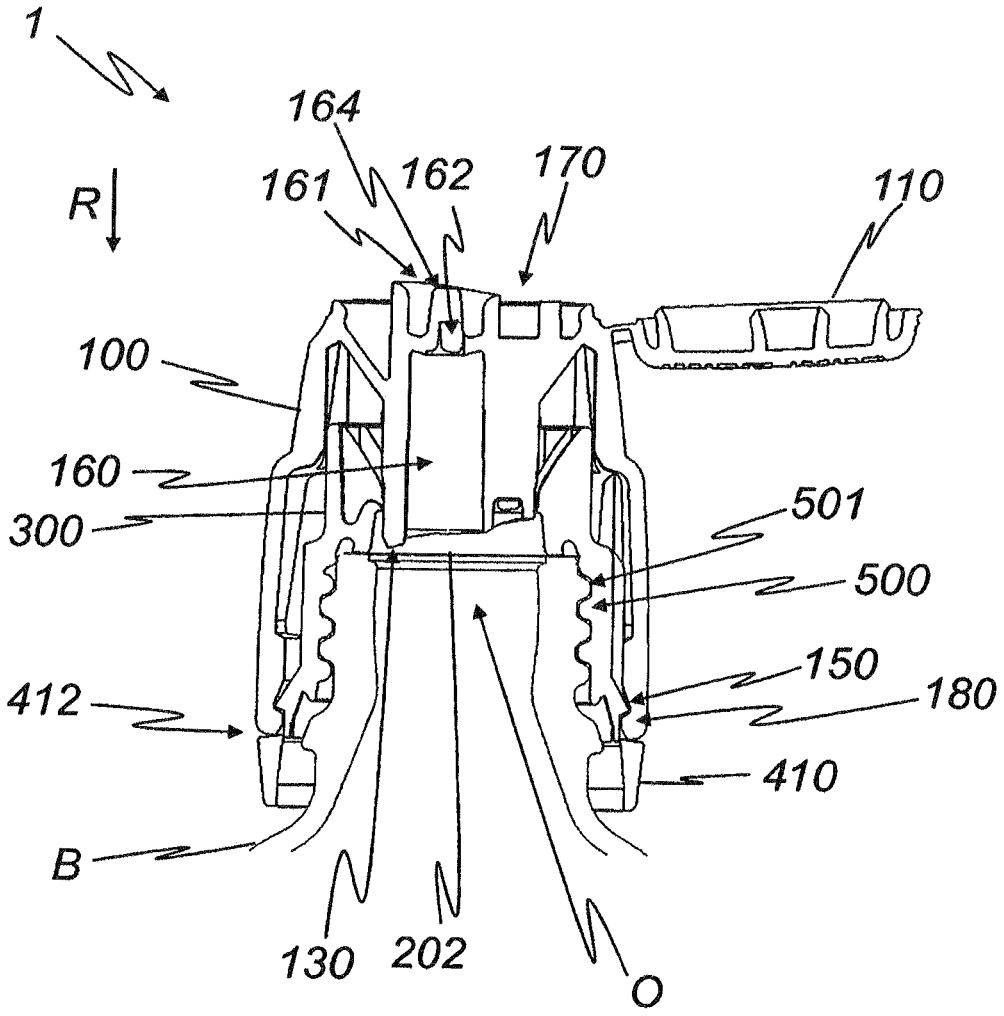
FIG. 6 shows a cross section through the closure shown in FIG. 5 in a first position.

FIG. 6 shows a longitudinal section through the closure 1 shown in FIG. 5 in a first position, which corresponds to the delivery condition of the filled container B up to the cap 110 shown in the open condition. In this view, the opening O of the container B is visible, which is closed by the closure 1. A sealing element 202, for example a multi-layer sealing film, is placed over the opening O and is fixed in a sealing manner, for example clamped in, by the closure 1 that is screwed on by means of for example an internal thread 500 onto an external thread 501 of the container B. It is also possible to provide a sealed fastening by means of a firmly bonded connection such as for example by means of gluing the sealing element 202 onto the container B, for example by induction sealing. The second element 100 of the closure 1 comprises a fluid channel 160 for removing a fluid from the container B, which fluid channel 160 is connected to a pour opening 161 via a lateral opening 162. Next to the pour opening 161, the second element 100 has a return channel opening 170, through which air can flow into the container B during removal of the fluid. By means of latching noses 180, the second element is held in a first position on latching pins 150 of the first element 300 of the closure 1. The securing element 410 may also carry corresponding latching noses (not shown), so that the closure 1 cannot be pulled off from the container B without destroying it, in particular not without tearing off the securing element 410 from the second element 100 on the predetermined breaking point 412. A securing element 410 according to the invention may have a sufficiently great extent along the displacement direction R, so that the securing element 410 is deformed during a displacement of the second element 100 from the first position into the second position by contact with the container B in such a way that the securing element 410 is irreversibly and visibly changed. Such a modification can take place in particular due to the fact that the securing element 410 tears off at least in sections from the second element 100 at the predetermined breaking point 412. As a result, the second element 100 cannot be displaced from the first into the second position without the securing element 410 being visibly and irreversibly changed in the course of it. The securing element 410 thus indicates to the consumer whether the second element 100 has already been manipulated, for example displaced into the second position, and thus whether the fluid in the container B has been tampered with.

Figure 7:
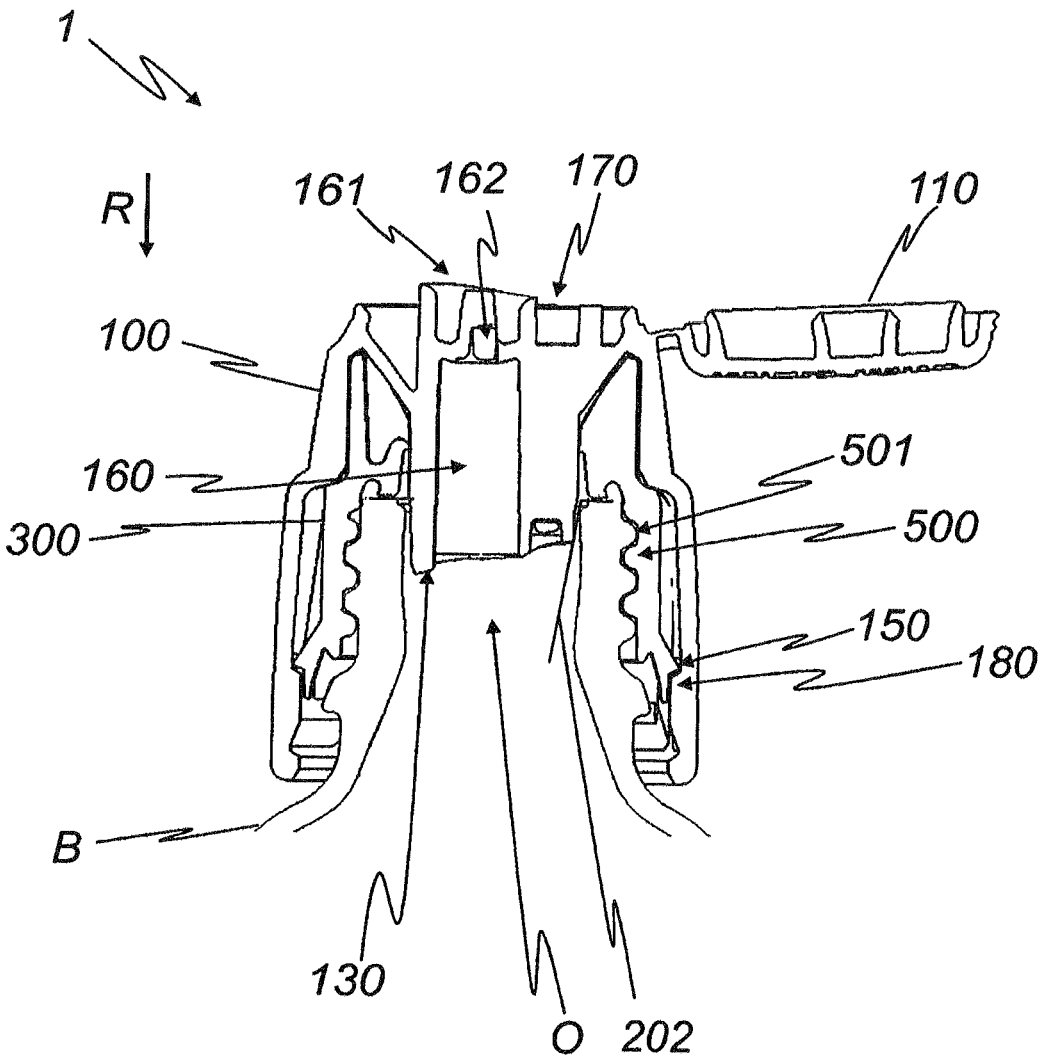
FIG. 7 shows a cross section through the closure shown in FIG. 5 in a second position.

FIG. 7 shows a longitudinal section through the closure 1 shown in FIG. 5 in a second position. Once the security element 410 has been torn off, the second element 100 may be displaced along a displacement direction R against the first element 300 towards the container B from the first position into the second position. In the course of this, the cutting element 130 severs the sealing element 202 and pushes it for example to one side, so that a fluid can be removed from the container B through the fluid channel 160. Also in the second position, the second element 100 is held by latching noses 180 on latching pins 150 of the first element 300. A form lock between the latching noses 180 and the latching pins 150 prevents the second element 100 from being pushed back into the first position and thus prevents the risk of a leak within the closure 1 occurring.

Figure 8:
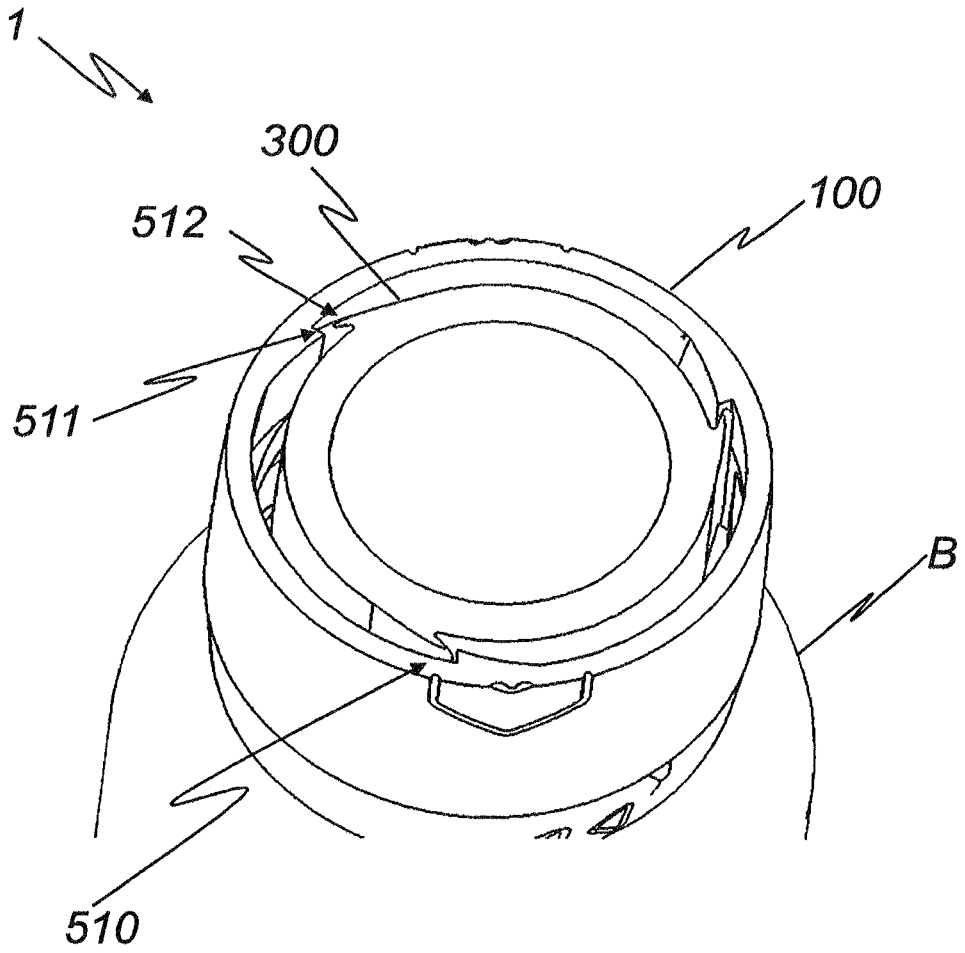
FIG. 8 shows a cross section through the closure shown in FIG. 5.

FIG. 8 shows a cross section through the closure 1 shown in FIG. 5. The first element 300 and the second element 100 surrounding the first element are connected to each other via a ratchet 510 that is formed by a number of follower ribs 511 and barrier ribs 512. In the example shown, three follower ribs 511 are provided on an inside of the first element 300, and three barrier ribs 510 that are complementary to the follower ribs 511 are provided on an outside of the second element 100. Due to the ratchet 510, the closure can be screwed onto the container B using a torque engaging the second element, however it cannot be screwed off.

Figure 9:
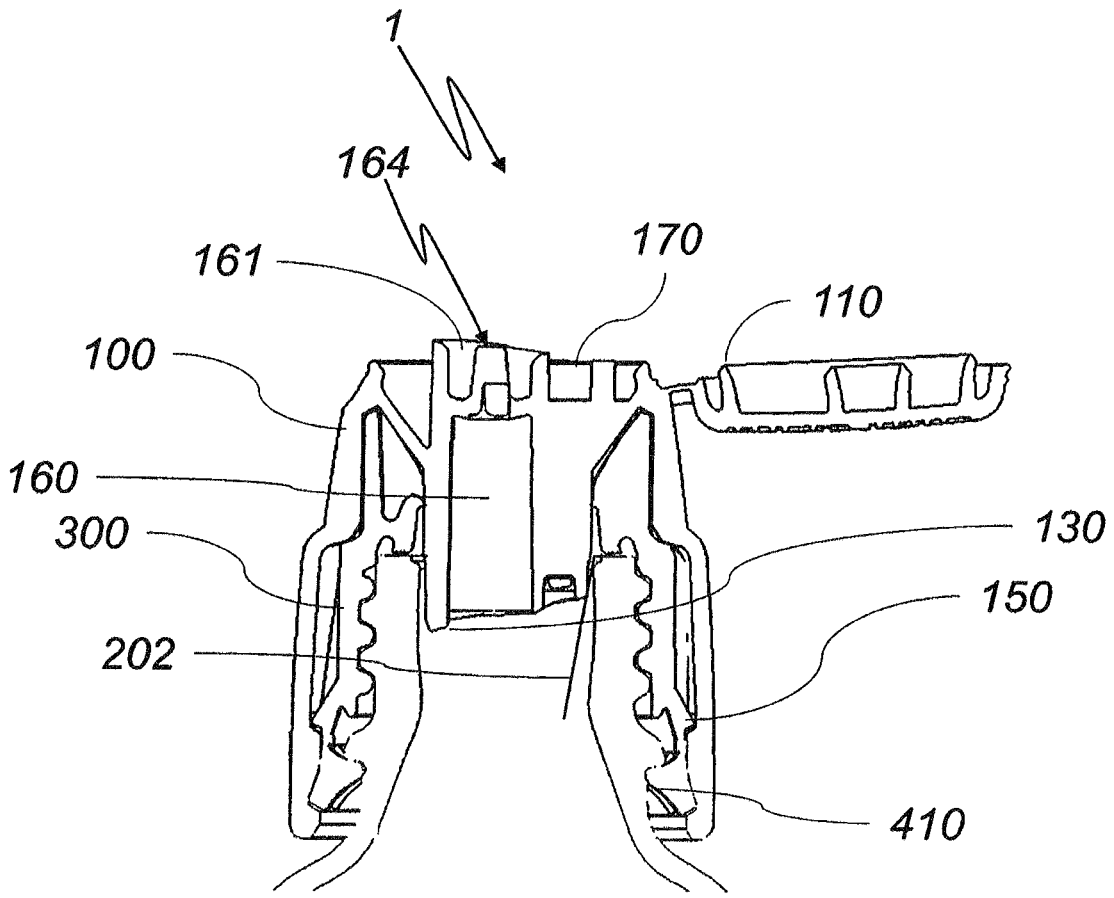
FIG. 9 shows a cross section through a closure shown in FIG. 5, having a securing element kinked at a predetermined kinking point and displaced under the closure.

FIG. 9 shows a cross section through a closure 1 shown in FIG. 5 with a securing element 410 snapped off at a predetermined breaking point (not shown, positioned analogous to the predetermined breaking point 412) and pushed under the closure 1. The kinking is preferably visibly irreversible. In the kinked condition shown, the securing element 410 may for example cooperate in a force- and/or form-locking manner with the closure 1, and as a result additionally secure the second (usage) position of the closure 1. Advantageously, the securing element 410 is mechanically decoupled from the first element 300 also in the kinked condition so that, in order to ensure the sealing effect, no externally acting forces are transmitted.

The invention claimed is:

1. A closure having a sealing element for a container (B) filled with a fluid, said closure having at least one securing mechanism designed to be visibly and irreversibly changed during an initial opening of the closure, and comprising an internal thread that is complementary to an external thread of the container (B) or an external thread that is complementary to an internal thread of the container (B), wherein the closure includes a ratchet configured to allow the closure to be screwed onto the container and to prevent the closure from being screwed off from the container (B), and wherein the securing mechanism comprises at least one visible securing element that is visibly and irreversibly changed by applying a force onto the closure relative to the container (B), which force has at least one force component along an axis (A) perpendicular to an opening level of an opening (O) of the container (B) that is closed by the closure, wherein the securing element a. is provided on the side of the closure that faces the container (B);
b. is designed in order to space the closure apart from the container (B);
c. is connected to the closure via at least one predetermined breaking point in a manner radially unstable to tension;
d. surrounds the opening (O) closed by the closure in an essentially annular manner;
e. is designed so that it can be torn off from the closure, wherein the securing element comprises a handle element, particularly a tab;
f. includes a tensionally unstable predetermined breaking point and/or predetermined kinking point in the circumference for attaching the tab-shaped handle element to the circumferential securing element,
g. has at least one latching nose, wherein the container (B) has at least one latching pin that is complementary to the latching nose, and/or
h. is formed of at least one elastically deformable plastic material.

2. The closure as claimed in claim 1, wherein a number of latching noses and a number of corresponding latching pins cooperate in a form-locking manner during a movement of the securing element along the axis (A) away from the container (B) and in a force-locking manner during a movement thereof towards the container (B).

3. The closure as claimed in claim 2, wherein the securing element is configured, due to the latching noses and/or the latching pins, with exactly one latching stage in a user-induced position, with a first element and a second element wherein the first element and the second element are displaceable relative to each other from a first position into a second position, i. wherein in the first position, the sealing element is intact, and
ii. wherein in the second position, the sealing element is penetrated by the second element and/or with the container (B) as the latching partner.

4. The closure a claimed in claim 3, wherein the securing element comprises at least one control element, through which it can be seen whether the second element is still in the initial position, wherein the at least one control element is irreversibly changed by displacing the second element relative to the first element.

5. The closure as claimed in claim 4, wherein the second element essentially completely envelopes the first element at least on the side facing away from the container (B).

6. The closure as claimed in claim 4, wherein the second element has at least one cutting surface for severing the sealing element.

7. The closure as claimed in claim 5, wherein the second element has at least one cutting surface for severing the sealing element.

8. The closure as claimed in claim 4, wherein in the second position, the second element cooperates with the sealing element in a sealing manner.

9. The closure as claimed in claim 5, wherein in the second position, the second element cooperates with the sealing element in a sealing manner.

10. The closure as claimed in claim 1, wherein the ratchet comprises a number of follower ribs and/or a number of snap-on ribs, wherein the follower ribs and the snap-on ribs cooperate in a form-locking manner when screwing the closure on and only in a force-locking manner during a screw-off attempt.

11. The closure as claimed in claim 10, wherein the follower ribs are provided on a first part of the closure that is accessible from an outside of the closure, and/or the snap-on ribs are provided on a second part of the closure that is connected to the internal thread.

12. The closure as claimed in claim 1, wherein the sealing element a. is designed to be film-like, as a multi-layer seal film, and/or
b. is connected in a firmly bonded manner neither with the closure nor with the container (B).

13. The closure as claimed in claim 4, wherein at least one return channel for pressure compensation between the container and an environment is provided in the closure.

14. The closure as claimed in claim 4, wherein a channel for fluid is provided eccentrically, in the closure, in the second element.

15. The closure as claimed in claim 4, wherein the first and second elements are sealed against each other via sealing surfaces at least in the second position.

16. The closure as claimed in claim 4, wherein the first element and/or the second element are provided with at least one latching nose, and the first element and/or the second element are provided with at least one latching pin that is complementary to the latching nose.

17. The closure as claimed in claim 16, wherein the at least one latching nose;

a. acts in a form-locking manner only against a displacement direction (R) and/or in a force-locking manner along the displacement direction (R), and/or
b. secures two positions against manipulation in two latching stages, the first position of the first element and of the second element set during production, and the second position generated by the user of the container.

18. The closure as claimed in claim 1, wherein a cap for sealing is provided, which a. seals both the fluid channel and the return channel, and/or
b. is connected with the closure by a flexible element.

19. The closure as claimed in claim 4, wherein the second element cannot be removed from the first position without destroying it or be pushed back from the second into the first position.

20. The closure as claimed in claim 5, wherein the second element cannot be removed from the first position without destroying it or be pushed back from the second into the first position.

21. The closure as claimed in claim 6, wherein the second element cannot be removed from the first position without destroying it or be pushed back from the second into the first position.

22. The closure as claimed in claim 15, wherein the second element cannot be removed from the first position without destroying it or be pushed back from the second into the first position.

23. The closure as claimed in claim 16, wherein the second element cannot be removed from the first position without destroying it or be pushed back from the second into the first position.

24. The closure as claimed in claim 17, wherein the second element cannot be removed from the first position without destroying it or be pushed back from the second into the first position.

25. The closure as claimed in claim 1, wherein the securing mechanism is provided in the fluid channel and/or in at least one return channel such that no free essentially linear path exists from a pour opening or the return opening to the sealing element.

26. The closure as claimed in claim 25, wherein the securing mechanism has at least one lateral opening and a closed underside provided relative to the sealing element or a vaulting facing away from the sealing element.

* * * * *